US011160327B2

(12) United States Patent
Taniguchi et al.

(10) Patent No.: US 11,160,327 B2
(45) Date of Patent: Nov. 2, 2021

(54) SHOE

(71) Applicants: ASICS Corporation, Kobe (JP); Toray Industries, Inc., Otsu (JP)

(72) Inventors: Norihiko Taniguchi, Kobe (JP); Kenta Moriyasu, Kobe (JP); Emi Katayama, Kobe (JP); Yuto Shimizu, Kobe (JP); Satoshi Naruko, Otsu (JP); Hiroshi Tsuchikura, Otsu (JP)

(73) Assignee: ASICS CORPORATION

( * ) Notice: Subject to any disclaimer, the term of this patent is extended or adjusted under 35 U.S.C. 154(b) by 388 days.

(21) Appl. No.: 16/066,669

(22) PCT Filed: Dec. 27, 2016

(86) PCT No.: PCT/JP2016/088936
§ 371 (c)(1),
(2) Date: Jun. 27, 2018

(87) PCT Pub. No.: WO2017/115805
PCT Pub. Date: Jul. 6, 2017

(65) Prior Publication Data

US 2018/0368524 A1 Dec. 27, 2018

(30) Foreign Application Priority Data

Dec. 28, 2015 (JP) ..... JP2015-255810

(51) Int. Cl.
*A43B 23/02* (2006.01)
*A43B 1/04* (2006.01)
(Continued)

(52) U.S. Cl.
CPC ..... *A43B 23/025* (2013.01); *A43B 1/04* (2013.01); *A43B 1/14* (2013.01); *A43B 5/00* (2013.01);
(Continued)

(58) Field of Classification Search
CPC ..... A43B 23/02
See application file for complete search history.

(56) References Cited

U.S. PATENT DOCUMENTS 3,927,229 A * 12/1975 Rall ..... D06N 3/0031 427/171
4,438,574 A * 3/1984 Johnson ..... A43B 23/0235 36/129
(Continued)

FOREIGN PATENT DOCUMENTS

CN 101583294 A 11/2009
CN 104106883 A 10/2014
(Continued)

OTHER PUBLICATIONS

Chinese Office Action dated Mar. 19, 2020, from Chinese Patent Application No. 201680076672.8, 6 sheets.
(Continued)

*Primary Examiner* — Andrew T Piziali
(74) *Attorney, Agent, or Firm* — Katten Muchin Rosenman LLP

(57) ABSTRACT

An object of the present invention is to provide a shoe having excellent comfort. The present invention provides a shoe including an upper material that is partially or fully formed of a fiber sheet, wherein the fiber sheet exhibits specific tensile characteristics at least in one direction.

11 Claims, 7 Drawing Sheets

(51) Int. Cl.

| | |
|---|---|
| ***D03D 15/56*** | (2021.01) |
| ***A43B 1/14*** | (2006.01) |
| ***A43B 5/00*** | (2006.01) |
| ***D02G 3/36*** | (2006.01) |
| ***D03D 1/00*** | (2006.01) |
| ***D03D 17/00*** | (2006.01) |
| ***D04B 1/18*** | (2006.01) |
| ***D04B 21/20*** | (2006.01) |

(52) U.S. Cl.

CPC ..... *A43B 23/02* (2013.01); *A43B 23/028* (2013.01); *A43B 23/0215* (2013.01); *A43B 23/0265* (2013.01); *A43B 23/0275* (2013.01); *D02G 3/36* (2013.01); *D03D 1/00* (2013.01); *D03D 15/56* (2021.01); *D03D 17/00* (2013.01); *D04B 1/18* (2013.01); *D04B 21/207* (2013.01); *D10B 2331/02* (2013.01); *D10B 2331/04* (2013.01); *D10B 2401/04* (2013.01); *D10B 2401/061* (2013.01); *D10B 2501/043* (2013.01)

(56) References Cited

U.S. PATENT DOCUMENTS

| | | | | |
|---|---|---|---|---|
| 2006/0060257 | A1* | 3/2006 | Iwashita | B32B 3/28 139/383 R |
| 2008/0110048 | A1 | 5/2008 | Dua et al. | |
| 2008/0318017 | A1* | 12/2008 | Mortimer | D03D 15/00 428/219 |
| 2010/0186874 | A1 | 7/2010 | Sussmann | |
| 2011/0078921 | A1 | 4/2011 | Greene et al. | |
| 2014/0310983 | A1 | 10/2014 | Tamm et al. | |
| 2014/0310984 | A1 | 10/2014 | Tamm et al. | |
| 2015/0104592 | A1 | 4/2015 | Itoi | |
| 2015/0111451 | A1 | 4/2015 | Hiroaki et al. | |
| 2015/0237960 | A1 | 8/2015 | Mallen et al. | |
| 2016/0053434 | A1* | 2/2016 | Feng | D06N 3/0015 442/200 |

FOREIGN PATENT DOCUMENTS

| | | | |
|---|---|---|---|
| CN | 105533889 | A | 5/2016 |
| JP | S59-164005 | A | 9/1984 |
| JP | H2-251427 | A | 10/1990 |
| JP | 3016014 | U | 9/1995 |
| JP | 2001-09845 | A | 4/2001 |
| JP | 2001098445 | | 4/2001 |
| JP | 2001-340102 | A | 12/2001 |
| JP | 2010-534535 | A | 11/2010 |
| JP | 2013-227692 | A | 11/2013 |
| JP | 2014-210176 | A | 11/2014 |
| TW | 201540212 | A | 11/2015 |

OTHER PUBLICATIONS

Notice of Allowance dated Mar. 20, 2020, from U.S. Appl. No. 16/066,668, 11 sheets.

Extended European Search Report for European Patent Application No. 16881779.9 dated Nov. 26, 2019, 10 sheets.

International Search Report for International Application No. PCT/JP2016/088936 dated Mar. 14, 2017.

Written Opinion of the International Searching Authority for for International Application No. PCT/JP2016/088936.

* cited by examiner

SHOE

CROSS-REFERENCE TO RELATED APPLICATION

This application claims priority to Japanese Patent Application No. 2015-255810, the disclosure of which is incorporated herein by reference in its entirety.

FIELD

The present invention relates to a shoe, more specifically, to a shoe in which an upper material is partially or fully formed of a fiber sheet.

BACKGROUND

Conventionally leather shoes with upper materials fabricated using natural leathers and synthetic leathers are used by many people. Meanwhile, fiber sheets such as woven fabrics and knitted fabrics are used in shoes used for jogging for forming such upper materials in view of air permeability and lightweight properties (see Patent Literature 1 below).

CITATION LIST

Patent Literature

Patent Literature 1: JP 2001-340102 A

SUMMARY

Technical Problem

Shoes provided with upper materials made of fiber sheets generally have excellent lightweight properties as compared with leather shoes or the like. Further, upper materials of shoes of this type easily deform corresponding to forces applied to feet, and such shoes are generally comfortable for users even when used for sports and the like. On the other hand, shoes of this type may possibly be uncomfortable due to the internal foot motion being comparatively free, thereby causing user's feet to significantly protrude from shoe soles when used for sports with intense movement. For such a problem, a sufficient solution has not been found. It is an object of the present invention to solve such a problem so as to improve the comfort of shoes in which upper materials are partially or fully formed of fiber sheets.

Solution to Problem

In order to solve the problem, the present invention provides a shoe including an upper material that is partially or fully formed of a fiber sheet, wherein the fiber sheet has both of tensile characteristics (A) and (B) below at least in one direction: (A) tensile characteristics such that an energy loss of a 10-mm-wide strip-shaped test piece made of the fiber sheet, when a load with a tensile energy of 50 mJ is applied to the test piece in the length direction and is then removed, is 40% or less; and (B) tensile characteristics such that a permanent strain of a 10-mm-wide strip-shaped test piece made of the fiber sheet, after a million times of deformation and restoration with an amount of strain determined by pulling the test piece in the length direction to a tensile energy of 50 mJ, is 10% or less.

DESCRIPTION OF EMBODIMENTS

Figure 1:
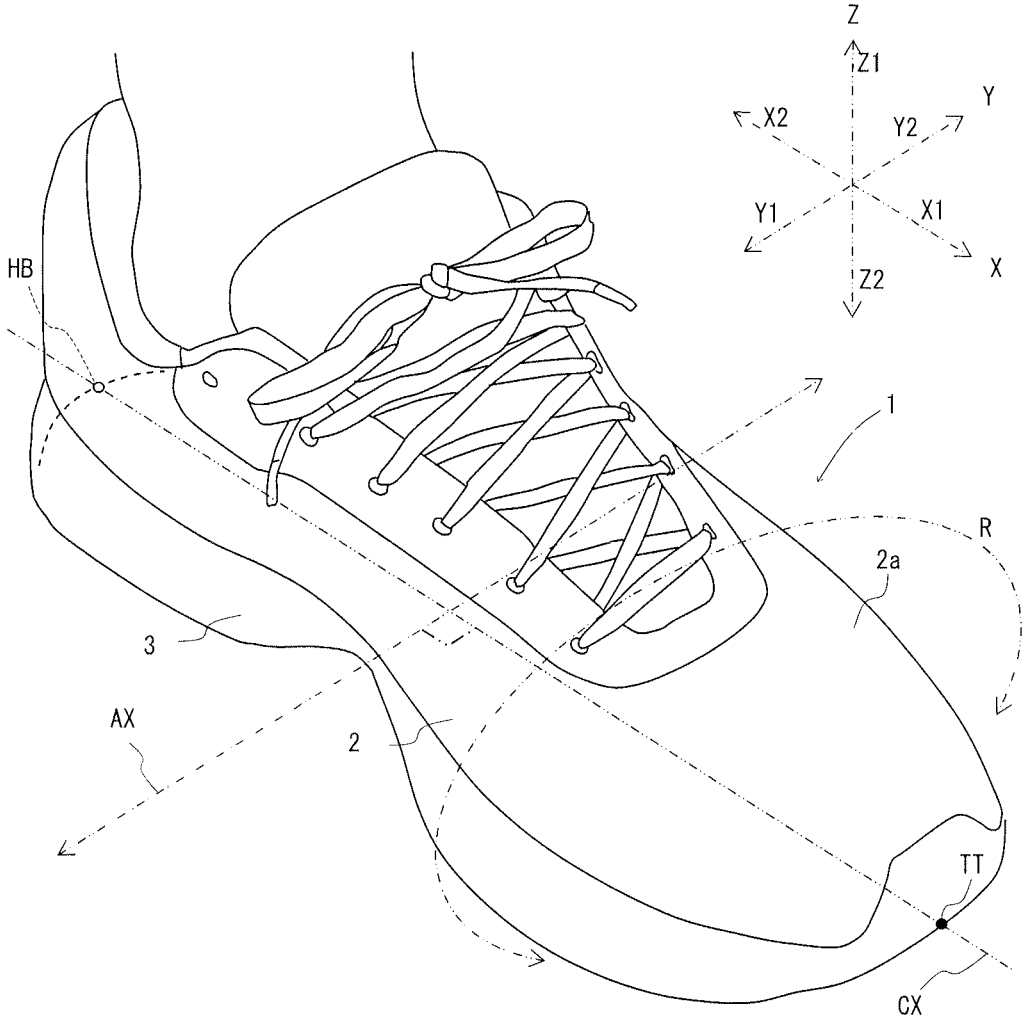
FIG. 1 is a schematic perspective view showing a shoe of an embodiment.

Hereinafter, an embodiment of a shoe according to the present invention will be described by taking, for example, a sneaker. FIG. 1 is a schematic perspective view showing the shoe of this embodiment. Hereinafter, an imaginary line connecting the most front end TT of the toe of the shoe 1 to the most rear end HB of the heel thereof will be referred to as a shoe center axis CX, and a direction along the shoe center axis CX will be referred to as a "length direction" of the shoe. In the length direction, a direction toward the toe of the shoe 1 (X1) will be referred to as "forward", and a direction toward the heel (X2) will be referred to as "backward". In the following description, among directions orthogonal to the shoe center axis CX, a direction parallel to the horizontal plane (Y) will be referred to as a "width direction" of the shoe, and a direction parallel to the vertical plane (Z) will be referred to as a "height direction" or "thickness direction" of the shoe. Further, in the following description, in the "width direction", a direction shown by the arrow Y1 in the figure will be referred to as "inward", and a direction shown by the arrow Y2 will be referred to as "outward". Further in the following description, in the "height direction" or "thickness direction", a direction shown by the arrow Z1 in the figure will be referred to as "upward", and a direction shown by the arrow Z2 will be referred to as "downward".

As shown in the figure, the shoe 1 of this embodiment includes an upper material 2 and a shoe sole member 3. The shoe 1 is a shoe including the upper material 2 that is partially or fully formed of a fiber sheet. In this embodiment, the upper material is fully formed of a fiber sheet 2*a*. The fiber sheet 2*a* constituting the upper material 2 exhibits both of the following tensile characteristics (A) and (B) at least in one direction:

(A) an energy loss of a 10-mm-wide strip-shaped test piece made of the fiber sheet, when a load with a tensile energy of 50 mJ is applied to the test piece in the length direction and is then removed, of 40% or less; and (B) a permanent strain of a 10-mm-wide strip-shaped test piece made of the fiber sheet, after a million times of deformation and restoration with an amount of strain determined by pulling the test piece in the length direction to a tensile energy of 50 mJ, of 10% or less.

The fiber sheet 2*a* constituting the upper material 2 preferably further exhibits the following tensile characteristics (C) in the direction in which it has the tensile characteristics (A) and (B):

(C) tensile characteristics such that an elongation of a 10-mm-wide strip-shaped test piece made of the fiber sheet, when a tensile load of 10 kgf is applied to the test piece in the length direction, of 10% or more and 80% or less.

Hereinafter; the tensile characteristics (A) will be simply referred to also as "characteristics A", and the tensile characteristics (B) also will be simply referred to as "characteristics B". Further, in the following description, the direction in which the fiber sheet 2*a* exhibits both of the characteristics A and the characteristics B may be referred to as "reinforcement direction", for example. Further, in the following description, the tensile characteristics (C) may be referred to simply as "characteristics C".

Whether the strip-shaped test piece has the characteristics A can be checked, specifically, according to the following method. First, a strip-shaped test piece having a width of 10 mm and a length in a direction orthogonal to the width direction of about 100 mm is prepared and is stored in a standard state (23±1° C. and 50±5% RH) for several hours or more. Then, one end in the length direction of the test piece is gripped by one of two chucks of a tensile tester, then the distance between the chucks is adjusted to 50 mm, and thereafter the other end of the test piece is gripped by the other chuck. Then, the one chuck is moved at a constant speed (10 min/min) to conduct the tensile test of the test piece. At this time, the amount of strain of the test piece is determined from the travel distance of the chuck, and the tensile energy is calculated from the value of strain and the value of the tensile stress applied to the test piece. Then, the movement of the chuck is stopped at the point at which the value of the tensile energy (cumulative value) reaches 50 mJ, and then the chuck is moved in the opposite direction at a constant speed (10 mm/min) until the value of the tensile stress reaches zero.

Figure 2:
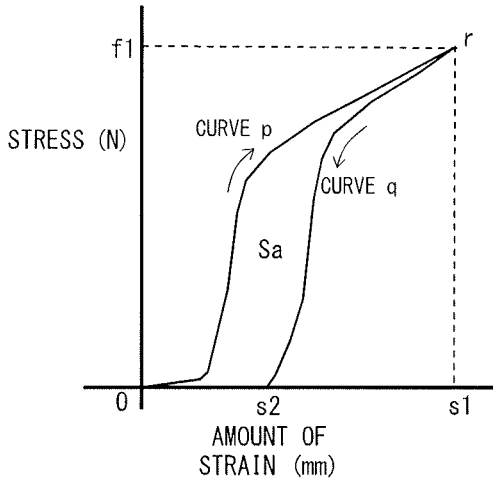
FIG. 2 is a graph showing an overview of a stress-strain curve in a tensile test of a fiber sheet.

At this time, stress-strain curves as shown in FIG. 2 are generally obtained. That is, a stress-strain curve as shown by a curve p is obtained in the section from the point at which the pulling of the test piece is started to the point at which the tensile energy reaches 50 mJ, and a stress-strain curve as shown by a curve q is obtained in the section from the point at which the tensile energy reaches 50 mJ to the point at which the value of the tensile stress reaches zero. Then, the loss energy (ΔE: mJ) can be calculated from the area (Sa) of the section surrounded by the two curves (i.e., the curve p and the curve q) and the x axis, and the "energy loss" in the characteristics A can be determined by the following calculation:

$$\text{Energy loss (\%)}=[(\Delta E)/50\ \text{(mJ)}]\times 100\%$$

Further, whether the strip-shaped test piece has the characteristics B can be checked, specifically according to the following method. First, the load P1 (N) when the load applied to the test piece is 50 mJ is determined from the "stress-strain curve" obtained in the method for checking whether the test piece has the characteristics A. Then, the test piece marked with two gauge lines at an interval of 50 mm is stored in the standard state (23±1° C. and 50±5% RH) for several hours or more, and the test piece is mounted to a high-cycle fatigue tester with the distance between chucks set to 50 mm. At this time, the test piece is mounted to the high-cycle fatigue tester so that the end edges of the chucks coincide with the gauge lines. Then, the high-cycle fatigue tester is set so that a force at the minimum of "1 (N)" and at the maximum of "P1 (N)" is applied to the test piece to conduct the fatigue test. That is, the fatigue test is performed in which a set of operation of increasing the force applied to the test piece from 1 (N) to P1 (N) and thereafter reducing it from P1 (N) to 1 (N) is repeated a million times is performed. The test environment is set to the standard state (23±1° C. and 50±5% RH), and the cycle speed in the fatigue test is set to 5 Hz. Then, the elongation (ΔL: mm) from the initial distance between the gauge lines (50 mm) can be measured by measuring the distance between the gauge lines of the test piece after the completion of the fatigue test, and the "permanent strain" of the characteristics B can be determined by the following calculation:

$$\text{Permanent strain (\%)}=[\Delta L\ \text{(mm)}/50\ \text{(mm)}]\times 100\%$$

Further, whether the strip-shaped test piece has the characteristics C can be checked, specifically, according to the following method. First, the test piece stored in the standard state (23±1° C. and 50±5% RH) for several hours or more is prepared, and one end in the length direction of the test piece is gripped by one of two chucks of a tensile tester, then the distance between the chucks is adjusted to 50 mm, and thereafter the other end of the test piece is gripped by the other chuck. Then, the one chuck is moved at a constant speed (10 mm/min) to conduct the tensile test of the test piece. Then, the movement of the chuck is stopped at the point at which the tensile load reaches 10 kgf; and the elongation (ΔE: mm) of the test piece is determined by subtracting the initial distance between chucks (50 mm) from the distance between chucks at that time. Whether the test piece has the characteristics C can be checked by the following calculation:

$$\text{Elongation (\%) with a tensile load of 10 kgf}=[\Delta E\ \text{(mm)}/50\ \text{(mm)}]\times 100(\%)$$

The "energy loss", "permanent strain", and "elongation with a tensile load of 10 kgf" can be determined, for example, by repeating the aforementioned tests about 10 times and calculating the arithmetic average of data excluding the maximum value and the minimum value from the obtained results.

Since the upper material 2 is formed of the fiber sheet 2*a*, the shoe 1 of this embodiment can give comfort to the user, even in the case where the foot accommodated in the shoe strongly hits the upper material 2 from the inside of the shoe, by deformation of the upper material 2 following the shape of the foot. Moreover, in the shoe 1, the fiber sheet 2*a* constituting the upper material 2 has the aforementioned tensile characteristics (characteristics A to C). In the shoe of this embodiment, the fiber sheet 2*a* forming the upper material 2 exhibits the characteristics A, thereby reducing the energy loss in tensile deformation of the upper material 2. Therefore, in the shoe of this embodiment, the upper material 2 easily restores its shape when the upper material 2 is deformed by the movement of the foot or the like. Accordingly the shoe of this embodiment can prevent the foot of the user from significantly protruding from the shoe sole even when used in sports with intense movement, and the user can move smoothly, as desired. Further, the fiber sheet 2*a* forming the upper material 2 has the characteristics C, so that the upper material is less likely to be deformed, and the shoe of this embodiment can prevent the foot of the wearer from significantly protruding from the shoe sole more reliably. Further, in the shoe of this embodiment, the fiber sheet 2*a* forming the upper material 2 has the characteristics B, thereby reducing the permanent strain of the upper material 2. Therefore, the shoe of this embodiment has a shape that is less likely to be deformed even when used multiple times and can exhibit the initial performance continuously for a long period of time.

In order to exhibit the aforementioned features more remarkably the fiber sheet 2*a* is preferably arranged in the shoe 1 so that the reinforcement direction in which the characteristics A and the characteristics B are exhibited falls within ±45° with respect to a direction orthogonal to the shoe center axis CX.

Figure 3:
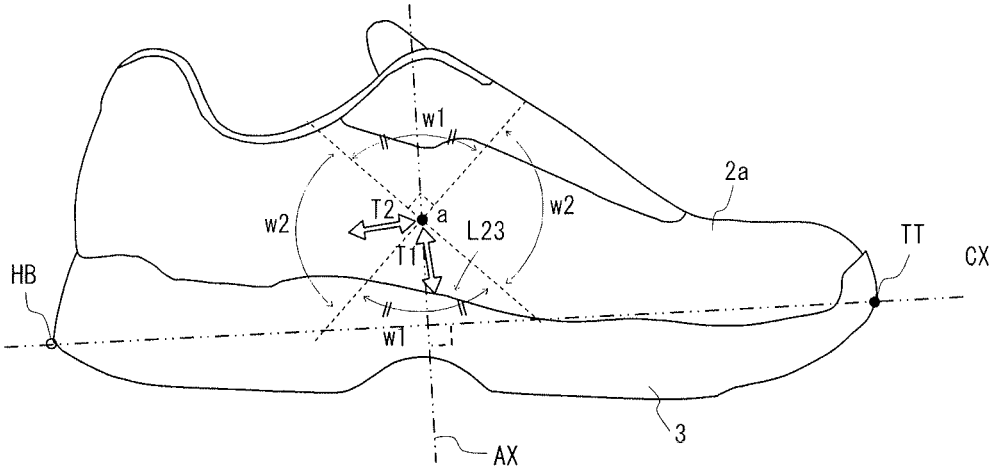
FIG. 3 is a schematic side view showing the appearance of the shoe as viewed from the medial side of the foot.

A description will be given for this with reference to FIG. 3. The direction along the imaginary line AX is the direction orthogonal to the shoe center axis CX in FIG. 3. When the straight line passing through the point a on the tangent plane is seen in the normal direction, a first range in which the straight line falls within ±45° with respect to the imaginary line AX is the range shown by W1 in FIG. 3, and a second range in which the straight line is −90° or more and less than −45° or more than +45° and less than 90° with respect to the imaginary line AX is the range shown by W2 in FIG. 3.

The upper material 2 is generally fixed to the shoe sole member 3 at a boundary portion L23 with the shoe sole member 3. For example, in the case where the upper material 2 is deformed by pushing the point a from the back surface side of the upper material 2, the value of the tension T1 generated in the first range W1 significantly increases immediately after the start of deformation of the upper material 2, but the value of the tension T2 generated in the second range W2 slowly increases. Therefore, in the shoe 1 of this embodiment, the reinforcement direction of the fiber sheet 2*a* preferably passes through the first range W1, in that the upper material 2 easily exhibits the property to rapidly restores its shape from the deformation. Further, in the shoe 1 of this embodiment, the fiber sheet 2*a* preferably exhibits both of the characteristics A and the characteristics B not only in a part of the directions within the first range but also in all the directions.

In the case where the fiber sheet 2*a* is a woven fabric that is plain-woven or twill-woven by warps and wefts, the direction of yarns having excellent strength can coincide with the reinforcement direction in which both of the characteristics A and B are exhibited, by employing the yarns having excellent strength for one or both of the warps and the wefts of the fiber sheet 2*a*. For example, in the case of using the fiber sheet 2*a* in which the warp direction coincides with the reinforcement direction, the shoe can be made suitable for sports with intense movement by forming the upper material 2 so that the warp direction falls within ±45° with respect to the direction orthogonal to the shoe center axis CX. That is, even in the case where deformation that causes displacement of the foot from the shoe during exercise occurs in the upper material, a restoring force is thereafter applied to the upper material of the shoe of this embodiment upwardly in the direction approaching the shoe center axis by arranging the fiber sheet 2*a* so that the reinforcement direction falls within ±45° with respect to the direction orthogonal to the shoe center axis. Therefore, even when used in sports with intense movement, the shoe of this embodiment, can prevent the foot of the user from significantly protruding from the shoe sole, and the user can move smoothly as desired.

Further, in the case where the fiber sheet 2*a* is a fabric that is warp knitted, such as tricot knitted and Raschel knitted, the warp knitting direction can coincide with the reinforcement direction.

Figure 4:
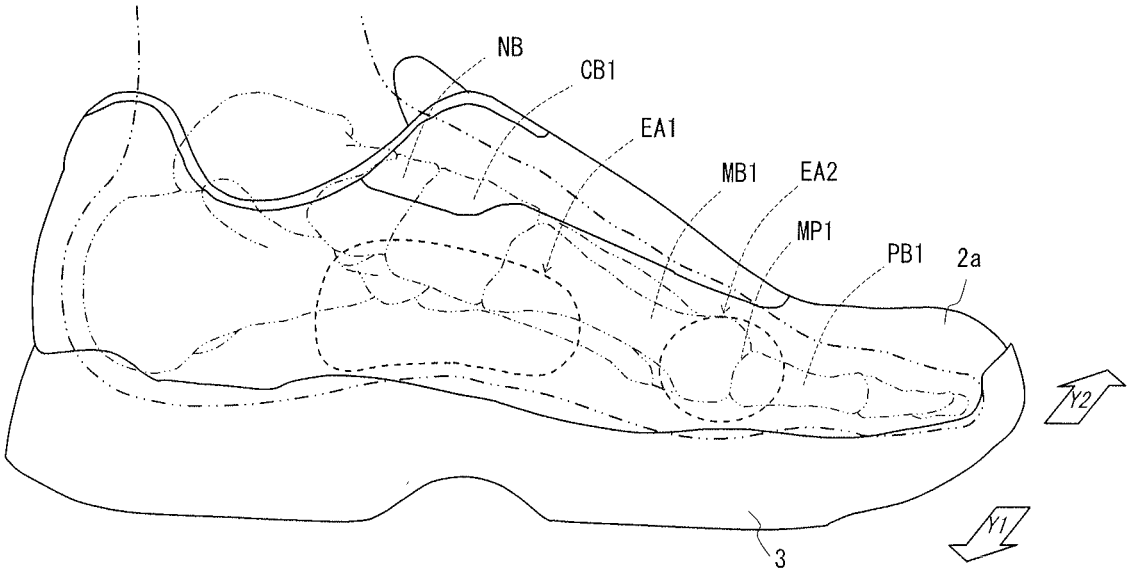
FIG. 4 is a schematic side view showing the appearance of the shoe as viewed from the medial side of the foot.
Figure 5:
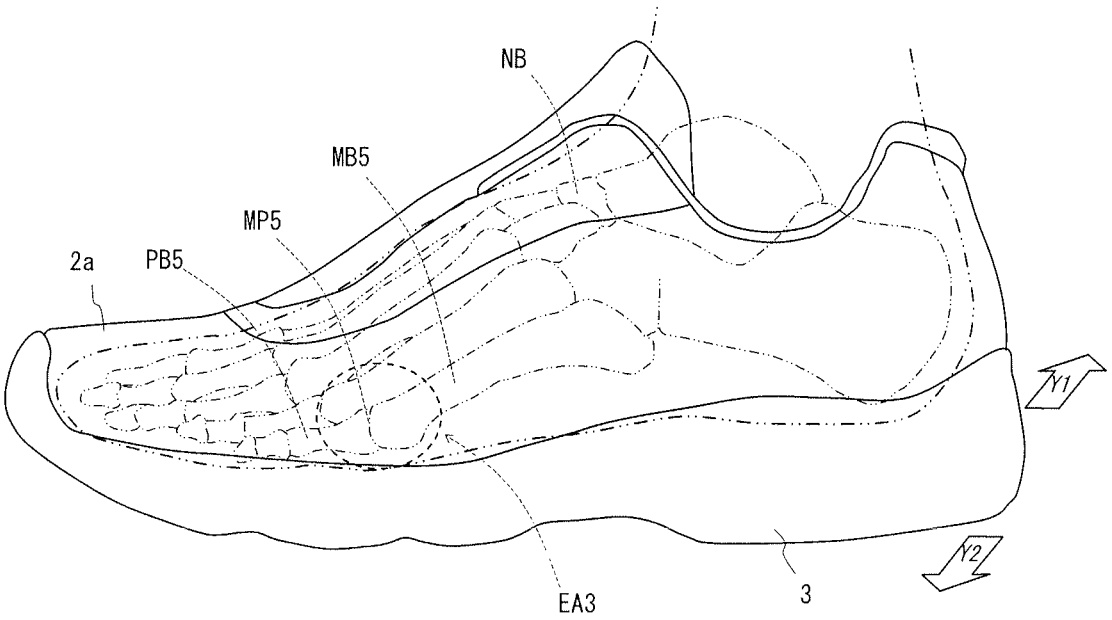
FIG. 5 is a schematic side view showing the appearance of the shoe as viewed from the lateral side of the foot.

The fiber sheet 2*a* is not necessarily arranged in the whole region of the upper material 2 so that the reinforcement direction falls within ±45° with respect to the direction orthogonal to the shoe center axis CX, and may be arranged only in a region that requires a particularly high strength for such a reinforcement direction. Examples of the region in which the reinforcement direction falls within the range of ±45° with respect to the direction orthogonal to the shoe center axis CX (which will be hereinafter referred to also as "reinforced region") include a region EA2 shown by the dashed line in FIG. 4 and a region EA3 shown by the dashed line in FIG. 5. That is, examples of the region that is preferably set as the reinforced region include the region EA2 covering the joint of the first toe between the basal bone PB1 and the metatarsal MB1 (the first metatarsophalangeal joint MP1) from the medial side of the foot. Further, examples of the region that is preferably set as the reinforced region include the region EA3 covering the joint of the fifth toe between the basal bone PB5 and the metatarsal MB5 (the fifth metatarsophalangeal joint MP5) from the lateral side of the foot, as shown by the dashed line in FIG. 5.

The shoe 1 in this embodiment has one or more of these two regions EA2 and EA3 set as the reinforced region(s) and can thereby reliably prevent the foot of the user from significantly protruding from the shoe sole, even when used in sports with intense movement.

In the shoe 1 in this embodiment, the fiber sheet constituting the upper material 2 is preferably a woven fabric composed of a plurality of yarns or a knitted fabric composed of a plurality of yarns, in order to allow the upper material 2 to exhibit an excellent strength. It is preferable that the fiber sheet 2*a* of this embodiment be a woven fabric or a knitted fabric, and the yarns be partially or fully composed of fusible yarns so that the yarns are fused with one another by the fusible yarns. Further, in the fiber sheet 2*a*, the fusible yarns are preferably arranged along a circumferential direction R about the shoe center axis CX.

The fusion of the yarns with one another by the fusible yarns improves the strength of the fiber sheet as compared with that before the fusion. That is, the fiber sheet tends to have a smaller energy loss and a smaller permanent strain by the fused yarns interacting with one another. Therefore, a shoe including such a fiber sheet can prevent the foot of the user from significantly protruding from the shoe sole more reliably. Further, the shoe of this embodiment has a shape that is less likely to be deformed, even when used multiple times, and maintains the initial performance more easily. Moreover, the upper material has an increased strength and an improved durability as compared with that before the fusion. Further, in the shoe of this embodiment, the fusible yarns are arranged along the circumferential direction R about the shoe center axis CX. Therefore, even in the case where deformation that causes the foot to protrude from the shoe sole occurs in the upper material during exercise, a restoring force is likely to be applied to the upper material after the deformation upwardly in the direction approaching the shoe center axis. Therefore, the shoe of this embodiment can reliably prevent the foot of the user from significantly protruding from the shoe sole, even when used in sports with intense movement. From these facts, in the shoe 1 in this embodiment, the yarns are preferably fused in the reinforced region. In other words, in the shoe 1 in this embodiment, the fiber sheet in which the yarns are fused with one another by the fusible yarns is preferably arranged in a portion covering the medial cuneiform. Further, in the shoe 1 in this embodiment, the fiber sheet in which the yarns are fused with one another by the fusible yarns is preferably arranged in a portion covering one or both of the first metatarsophalangeal joint and the fifth metatarsophalangeal joint. When the yarns constituting the upper material covering the metatarsophalangeal joints of the first toe and the fifth toe, which are portions susceptible to deformation that causes displacement of the foot from the shoe during exercise, fuse with one another in such portions, the foot of the user can be prevented more reliably from significantly protruding from the shoe sole. Further, with the deformation of the metatarsophalangeal joints of the first toe and the fifth toe during exercise, the deformation of the upper material covering such portions also increases. Therefore, the effect of improved durability by the fusion can be exhibited more remarkably in such portions.

In the shoe 1 in this embodiment, in the case where the fiber sheet is a woven fabric or a knitted fabric composed of a plurality of yarns, it is preferable that the yarns constituting the fiber sheet be partially or fully elastic yarns made of an elastomer, in order to allow the upper material 2 to exhibit an appropriate elasticity. The upper material formed of the elastic yarns made of an elastomer has an appropriate elasticity and therefore easily follows the motion of the foot during exercise, thereby having an effect of improving the fitness. Further, the upper material has a small energy loss in tensile deformation and therefore can prevent the foot of the user from significantly protruding from the shoe sole more reliably. Further, the upper material has a reduced permanent strain. Therefore, a shoe including such an upper material has a shape that is difficult to deform, even when used multiple times, and can maintain the initial performance.

In the case of employing fusible yarns as forming materials for the fiber sheet 2*a* of this embodiment, common fusible yarns can be employed as the fusible yarns. Examples of the fusible yarns include mono-filament yarns having one sheath-core or side-by-side heat fusible fiber and composed only of the heat fusible fiber. Further, examples of the fusible yarns include multi-filament yarns having a plurality of heat fusible fibers as described above, and multi-filament yarns having one heat fusible fiber and one or more non-heat fusible fibers. Here, the "non-heat fusible fibers" mean fibers exhibiting no fusibility at a temperature at which heat fusible fibers can thermally fuse with one another. Specifically in the case where the heat fusible fibers are of the sheath-core type, and a resin constituting the sheaths is a crystalline resin having a specific melting point (Tm (° C.)), the "non-heat fusible fibers" mean fibers at least the surfaces of which are formed of a crystalline resin having a melting point higher than Tm (° C.) or an amorphous resin having a glass transition temperature higher than Tm (° C.). Further, in the case where the heat fusible fibers are of the sheath-core type, and the resin constituting the sheaths is an amorphous resin having a specific glass transition temperature (Tg (° C.)), the "non-heat fusible fibers" mean fibers at least the surfaces of which are formed of a crystalline resin having a melting point higher than Tg (° C.) or an amorphous resin having a glass transition temperature higher than Tg (° C.). The temperature difference in melting point and glass transition temperature between the cores and the sheaths of the heat fusible fibers, and the temperature difference in melting point and glass transition temperature between the sheaths of the heat fusible fibers and the resin forming the surfaces of the non-heat fusible fibers are preferably 20° C. or more and 150° C. or less, more preferably 30° C. or more and 120° C. or less.

Here, the melting point and the glass transition temperature of the resin can be checked by differential scanning calorimetry analysis (DSC) at a heating rate of 10° C./min, and can be determined respectively as the "melting peak temperature" and the "midpoint glass transition temperature" specified in JIS K 7121.

The fusible yarns are not necessarily composed of continuous fusible fibers and may be spun yarns fabricated by spinning comparatively short (for example, 2 m or less) fusible fibers. In the case where the fusible yarns are spun yarns, the fusible yarns may be blended yarns composed of different heat fusible fibers, or may be blended yarns of heat fusible fibers and non-heat fusible fibers.

As the heat fusible fibers, heat fusible fibers of the sheath-core type or the side-by-side type fabricated with two or more types of polymers having different melting points or softening points can be employed. More specifically, examples of the heat fusible fibers include sheath-core fibers the cores of which are formed of a crystalline polyester resin such as a polyethylene terephthalate resin and the sheaths of which are formed of a crystalline polyester resin having a melting point lower than that of the aforementioned polyester resin or an amorphous polyester resin having a glass transition temperature lower than the melting point of the aforementioned polyester resin, and sheath-core fibers the cores of which are formed of a crystalline polyester resin and the sheaths of which are formed of a crystalline polyamide resin having a melting point lower than that of the aforementioned polyester resin.

In the case of employing the elastic yarns as forming materials for the fiber sheet 2*a* of this embodiment, common elastic yarns can be employed as the elastic yarns. Examples of the elastic yarns include mono-filament yarns having one elastic fiber formed of an elastomer and composed only of the elastic fiber, multi-filament yarns having a plurality of elastic fibers, and multi-filament yarns having one elastic fiber and one or more inelastic fibers.

As the elastomer constituting the elastic yarns, an elastomer having such elastic restorability that a tensile elongation at break in the standard state (23±1° C. and 50±5% RH) is 50% or more and an elastic recovery rate from elongation at 10% elongation is 80% or more is preferable.

Here, the elastic recovery rate from elongation can be determined in accordance with JIS L1013-1999. That is, after being allowed to stand in a temperature and humidity controlled room at 20° C. and 65% RH for 24 hours, a measurement sample is stretched to 10% of the sample length under conditions of a sample length of 250 mm and a tensile speed of 300 mm/minute using a tensile tester, followed by standing for one minute and unloading at the same speed. After it is allowed to stand for three minutes, the measurement sample is stretched again to a certain elongation at the same speed to measure the residual elongation from the recorded load-elongation curve, so that the elastic recovery rate from elongation can be calculated from the average of 5 times of measurements by the following formula (unit: %):

$$E=[(L\cdot L\mathbf{1})/L]\times 100$$

(where E: Elastic recovery rate from elongation (%), L: Elongation at 10% elongation (mm), and L1: Residual elongation (mm))

In the case where the elastic yarns are mono-filament yarns, the tensile characteristics of the elastomer generally directly affect the tensile characteristics of the yarns. Accordingly, in the case where the elastic yarns are mono-filament yarns, the elastic yarns generally exhibit the tensile elongation at break and the elastic restorability that are similar to those of the elastomer. In this embodiment, also in the case where the elastic yarns are multi-filament yarns, the elastic yarns preferably have such tensile elongation at break and such elastic restorability. Since the upper material formed of mono-filament elastic yarns has an appropriate elasticity the upper material easily follows the motion of the foot during exercise and is advantageous in improving the fitness. Also, the upper material has a reduced energy loss in tensile deformation, and therefore can prevent the foot of the wearer from significantly protruding from the shoe sole more reliably. Further, in a shoe including such an upper material, the permanent strain of the upper material is reduced. Therefore, the shoe has a shape that is less likely to be deformed, even when used multiple times, and can maintain the initial performance.

Here, for example, when sheath-core fibers are formed of two types of polyester thermoplastic elastomers or the like having different melting points or glass transition temperatures, and the sheaths are formed of a polyester thermoplastic elastomer having a low melting point or a glass transition temperature, yarns that are fusible and elastic can be obtained using such fibers.

Examples of such polyester thermoplastic elastomers useful for fabricating the yarns that are fusible and elastic include a polyester resin that is allowed to exhibit rubber elasticity by partially changing diols and dicarboxylic acids that are polymer constituent units to other diols and dicarboxylic acids, and a polyester resin that is allowed to exhibit rubber elasticity by introducing a partially crosslinked structure. Further, the fibers may be such that the cores are formed of a polyester thermoplastic elastomer, and the sheaths are formed of a polyamide thermoplastic elastomer having a melting point or a glass transition temperature lower than those of the polyester thermoplastic elastomer. Specifically as the elastic fibers exhibiting heat fusibility sheath-core fibers the cores of which are composed of a polyester elastomer having a melting point of 190° C. or more and 250° C. or less and the sheaths of which are composed of a polyester elastomer having a melting point of 140° C. or more and 190° C. or less are, for example, preferable.

Further, in the shoe 1 in this embodiment, the fiber sheet 2*a* preferably has heat shrinkability in that it easily gives the desired shape of the upper material 2. In the shoe 1 in this embodiment, the fiber sheet 2*a* having heat shrinkability enables the upper material to heat-shrink into a shape along the outer surface of a forming mold corresponding to the space accommodating the foot by covering the forming mold with the upper material fabricated to have a shape that is close to the final shape to some extent, followed by heating. That is, the fiber sheet 2*a* having heat shrinkability can facilitate producing a shoe having excellent shape accuracy. Further, the fiber sheet 2*a* having heat shrinkability also facilitates finely adjusting the upper material of the shoe that has been already fabricated so as to fit to the shape of the foot of the user.

In order to fit the upper material to the forming mold, the fiber sheet preferably exhibits high heat shrinkability in the width direction of the shoe rather than in the length direction. That is, the upper material preferably exhibits high heat shrinkage ratio in a second direction orthogonal to a first direction extending from the heel to the toe rather than in the first direction. In the cross section orthogonal to the first direction, a change in curvature of the contour of the foot is large, and it is difficult to allow the upper material to extend along the outer surface of the forming mold corresponding to the foot in the cross section. It is easy for the shoe of this embodiment to give a shape fitting to the forming mold even in such a portion by utilizing the heat shrinkability of the upper material. Further, in a region of the cross section orthogonal to the first direction in which the change in curvature of the contour of the foot is particularly large, it is particularly difficult to fit the upper material to the forming mold. That is, the effect of giving a shape fitting to the forming mold and further the foot can be exhibited more remarkably by arranging the upper material having heat shrinkability in such a region. Examples of the region in which the change in curvature of the contour of the foot is particularly large include a region EA1 corresponding to the plantar arch, which is shown by the dashed line in FIG. 4, extending from the navicular bone NB through the medial cuneiform CB1 to the first metatarsal MB1.

Further, in order to prevent the foot of the user from protruding outwardly from the shoe sole during exercise more reliably the upper material 2 preferably sufficiently fits to the foot in the reinforced region. Accordingly, examples of the region in which the heat shrinkability is particularly preferably exhibited include the region EA2 covering the joint of the first toe between the basal bone PB1 and the metatarsal MB1 (first metatarsophalangeal joint MP1) from the medial side of the foot, and a region EA3 covering the joint of the fifth toe between the basal bone PB5 and the metatarsal MB5 (the fifth metatarsophalangeal joint MP5) from the lateral side of the foot.

In order to allow the fiber sheet 2*a* to exhibit heat shrinkability shrinkable yarns containing fibers exhibiting heat shrinkability may be employed as constituents of the fiber sheet 2*a*. The heat shrinkable fibers constituting the shrinkable yarns preferably have a length after being shrunk by heating of 90% or less, more preferably 85% or less, with respect to the length before heating. Further, the shrinkable yarns also preferably have a length after being shrunk by heating of 90% or less, more preferably 85% or less, with respect to the length before heating. The shrinkage ratio of fibers or yarns can be determined, for example, by comparing the natural lengths of the fibers or yarns stored in the standard state (23±1° C. and 50±5% RH) for several hours or more between before and after heating. The shrinkable yarns preferably have a shrinkage stress per unit thickness in the range of 150° C. or more and 210° C. or less that is 0.05 cN/dtex or more and 2.00 cN/dtex.

The polyethylene terephthalate resin generally has a crystallization temperature of about 150° C. and a melting point of 200° C. or more. Further, fibers obtained by cooling a thermally fused polyethylene terephthalate resin while forming it into fibers can be made amorphous by performing the cooling rapidly. Such polyethylene terephthalate resin fibers, when heated to their crystallization temperature or higher, generally undergo molecular rearrangement to exhibit high heat shrinkability. Accordingly the shrinkable yarns preferably contain fibers having excellent heat shrinkability such as polyethylene terephthalate resin fibers.

Such heat shrinkability is exhibited in the same manner not only in the polyethylene terephthalate resin that is a condensation polymer of terephthalic acid and ethylene glycol, but also in a polyethylene terephthalate resin in which the terephthalic acid is partially replaced with another dicarboxylic acid, or a polyethylene terephthalate resin in which the ethylene glycol is partially replaced with another diol. In particular, in order to facilitate allowing the shrinkable yarns to exhibit excellent heat shrinkability the polyethylene terephthalate resin forming the heat shrinkable fibers is preferably a polyethylene terephthalate resin in which the terephthalic acid is partially changed to another dicarboxylic acid such as isophthalic acid, and the ethylene glycol is partially changed to another diol such as 2,2-bis (4-hydroxyphenyl) propane.

In the case where the fiber sheet 2*a* is a woven fabric, the fiber sheet 2*a* can exhibit heat shrinkability by its warps or wefts partially containing such polyethylene terephthalate resin fibers. The fiber sheet 2*a* preferably exhibits heat shrinkability not only in one direction but also multiple directions, and both the warps and wefts preferably contain shrinkable yarns. The heat shrinkability of the fiber sheet 2*a* can be adjusted by the ratio of polyethylene terephthalate resin fibers in the warps and wefts. At that time, the ratios of the polyethylene terephthalate resin fibers may be different between one warp and another warp, the ratios of the polyethylene terephthalate resin fibers may be different between one weft and another weft, or the fiber sheet 2*a* may include warps or wefts containing no polyethylene terephthalate resin fibers at a suitable ratio.

The same applies to the case where the fiber sheet 2*a* is a knitted fabric, and the heat shrinkability can be adjusted by the content of the polyethylene terephthalate resin fibers.

The fusible yarns, the elastic yarns, and the shrinkable yarns generally have a total fineness of 20 dtex or more and 5000 dtex or less, though it also depends on the application of the shoe. The total fineness of these yarns is preferably 30 dtex or more and 2000 dtex or less.

In the case where the fiber sheet 2*a* is a woven fabric by warps and wefts and the fiber sheet 2*a* is formed of fusible yarns, the warps and wefts are generally fused with each other at their intersections. It is advantageous to appropriately adjust the number of fusion points per unit area in order to allow the fiber sheet 2*a* to exhibit the characteristics A, the characteristics B, and the characteristics C. Therefore, the fiber sheet 2*a* preferably has a weave density of warps and wefts measured in accordance with JIS L 1096 (2010). 8. 6. 1 A that is 10 yarns/2.54 cm or more and 200 yarns/2.54 cm or less.

Figure 6:
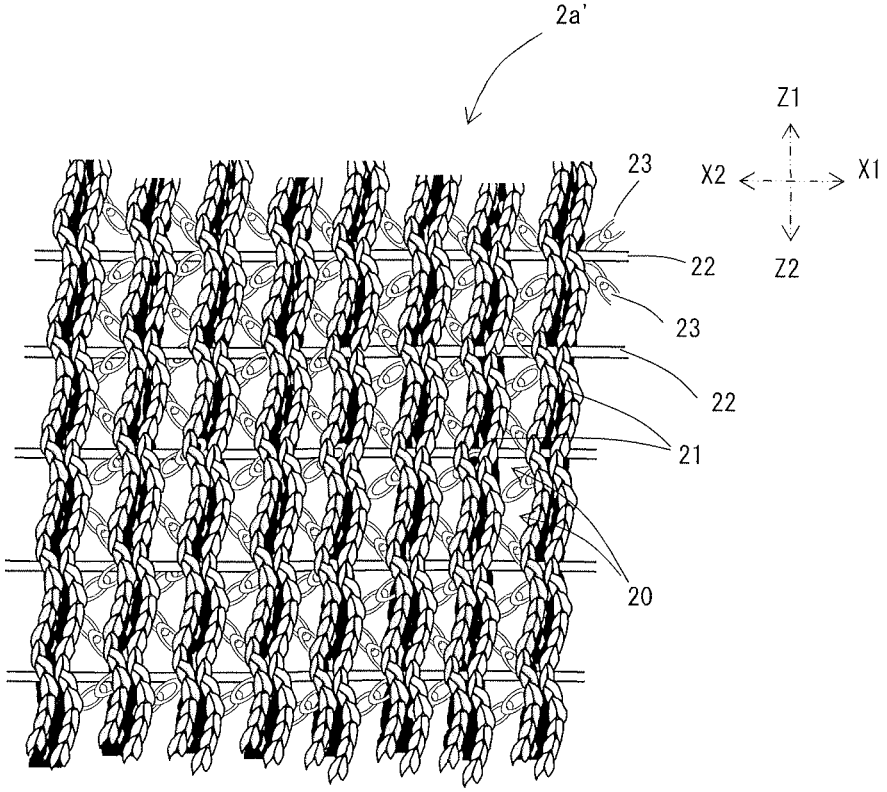
FIG. 6 is a schematic plan view showing the appearance of one surface side of a fiber sheet that is a knitted fabric.
Figure 7:
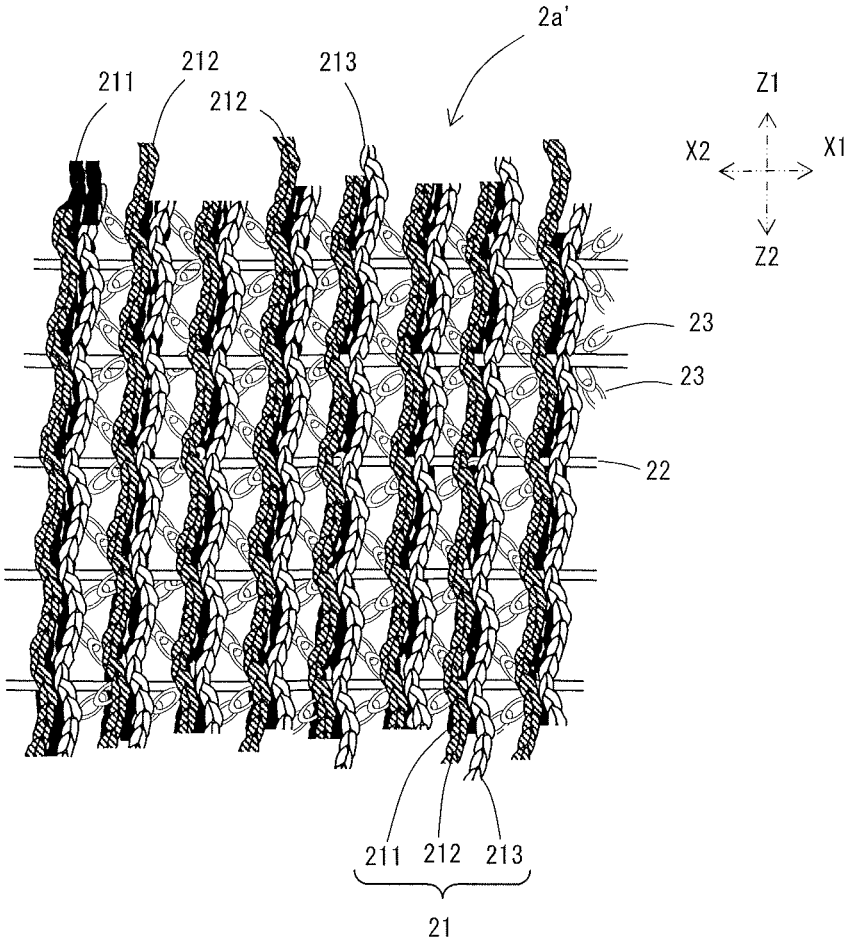
FIG. 7 is a schematic plan view showing the appearance of the other surface side of the fiber sheet that is a knitted fabric.

In the case of employing a knitted fabric as the fiber sheet 2*a*, the upper material can have excellent strength and excellent air permeability for example, by employing a lace-knitted fabric in which many through holes passing therethrough in the thickness direction and having an opening area of 0.5 $mm^2$ to 5 $mm^2$ are formed. As the knitted fabric, the knitted fabric as shown in FIGS. 6 and 7, for example, can be employed. FIG. 6 schematically shows the appearance of a fiber sheet 2*a*' that is a knitted fabric constituting the upper material 2 as viewed from the front surface side of the shoe 1, and a plurality of through holes 20 having an opening area of about 1 $mm^2$ are formed through the fiber sheet 2*a*'. FIG. 7 schematically shows the appearance of the fiber sheet 2*a*' from the back surface side of the upper material 2 (inside of the shoe), and the fiber sheet 2*a*' is knitted with a plurality of yarns, as shown in these figures.

The fiber sheet 2*a*' is provided with a plurality of string articles 21, where the plurality of string articles 21 finely meandering are parallelly arranged to have slight gaps, and the through holes 20 are provided between the gaps of the string articles 21. The fiber sheet 2*a*' of this embodiment has an appearance as if it is composed only of the string articles 21, but actually further includes elastic yarns 22 that are colorless transparent mono-filament yarns thinner than the string articles 21, and shrinkable yarns 23 that are further thinner than the elastic yarns. In the fiber sheet 2*a*' of this embodiment, the elastic yarns 22 and the shrinkable yarns 23 are fusible yarns having heat fusibility.

The plurality of string articles 21, the plurality of elastic yarns 22, and the plurality of shrinkable yarns 23 are used for forming the fiber sheet 2*a*' in this embodiment. In the fiber sheet 2*a*' in this embodiment, the string articles 21 are arranged extending along the circumferential direction R about the shoe center axis CX. Meanwhile, the elastic yarns 22 are parallelly arranged with intervals provided in the width direction of the shoe, so that the length direction is parallel to the shoe center axis CX. That is, the elastic yarns 22 are arranged in the form of skewering the string articles 21 in the upper material 2. As described above, the plurality of string articles 21 are parallelly arranged with intervals provided in the fiber sheet 2*a*' in this embodiment, and therefore portions where the gaps of the string articles 21 and the gaps of the elastic yarns 22 overlap each other serve as the through holes 20. The shrinkable yarns 23 are arranged in the form of partially being woven into the string articles 21 and partially being interlaced with the elastic yarns 22. Accordingly, in the upper material 2, the string articles 21, the elastic yarns 22, and the shrinkable yarns 23 are fixed to one another.

Each of the string articles 21 is composed of three thin strings 211, 212, and 213 that are thinner than the string articles 21, and is formed by aligning the three thin strings. The three thin strings 211, 212, and 213 respectively have different colors and are composed of chain-knitted yarns having the different colors. In the fiber sheet 2*a*', the plurality of string articles 21 are arranged so that the first thin strings 211 of the three thin strings are arranged on the outer surface side of the shoe, and the second thin strings 212 and the third thin strings 213 are arranged on the inner surface side of the shoe. Further, in the plurality of string articles 21, the second thin strings 212 are arranged closer to the front surface side of the shoe than the third thin strings 213 are. Accordingly, in the upper material 2 of this embodiment, the fiber sheet 2*a*' looks as if it is formed only of the first thin strings 211 when the fiber sheet 2*a*' is viewed at the right angle, but the second thin strings 212 can be visually recognized through the gaps between the string articles 21 when the fiber sheet 2*a*' is viewed from the front side of the shoe. Further, in the upper material 2 of this embodiment, the third thin strings 213 can be visually recognized through the gaps between the string articles 21 when the fiber sheet 2*a*' is viewed from the back surface side of the shoe. As described above, the shoe of this embodiment has the second thin strings 212 and the third thin strings 213 in different colors and therefore has different hues depending on the view angle.

That is, the shoe of this embodiment has excellent aesthetic appearance by forming the upper material 2 from the plurality of string articles 21 extending in the circumferential direction R about the shoe center axis CX and parallelly arranged with gaps provided in the shoe center axis direction, forming each of the string articles 21 with three or more thin strings including the first thin string 211, the second thin string 212, and the third thin string 213 that are thinner than the string article 21, arranging the first thin strings 211 on the front surface of the upper material 2, arranging the second thin strings 212 and the third thin strings 213 on the back surface side of the first thin strings 211, arranging the second thin strings 212 along one of two side edges of the first thin strings 211, and arranging the third thin strings 213 having a color different from the color of the second thin strings 212 along the other side edge thereof.

The upper material 2 in this embodiment can exhibit excellent aesthetic appearance by the fiber sheets 2*a* and 2*a*', as described above, and can exhibit excellent aesthetic appearance also by members other than the fiber sheets 2*a* and 2*a*'. For example, resin films are useful for smoothening the front surface of the upper material. Further, it is easier to print patterns or characters on resin films than on fiber sheets. Such patterns or characters can be provided on resin films also by embossing or the like. Therefore, when the upper material is at least partially formed of a composite sheet having a fiber sheet and a resin film, the upper material can exhibit a texture that is difficult to be exhibited only with a fiber sheet. The upper material preferably further contains a resin film bonded to one side of or both sides of the fiber sheet, in that design choices increase as described above. The resin film may be colored in various colors. The resin film may contain an extender pigment in consideration of hiding properties. The resin film is preferably arranged to be exposed on at least one of the outer surface and the inner surface of the shoe and is more preferably arranged to be exposed on the outer surface of the shoe.

Reactive adhesives that are in liquid form at normal temperature (for example, 23° C.), hot-melt adhesives that are in solid form at normal temperature, pressure-sensitive adhesives that are in semi-solid form at normal temperature, or the like can be used for bonding the resin film to the fiber sheet. Here, if such adhesives excessively penetrate between the fibers of the multi-filament yarns constituting the fiber sheet or between adjacent yarns, the original suppleness of the fiber sheet may possibly fail to be sufficiently reflected on the upper material. Therefore, the adhesive to be used is preferably a hot-melt adhesive. The resin film may be a hot-melt adhesive processed into a film. However, the resin film that is fully formed from a hot-melt adhesive causes softening of the fiber sheet as a whole when thermally bonded to the fiber sheet, and therefore projections and recesses are likely to be formed on the surface on the opposite side to the bonding surface of the fiber sheet. Then, in the case where patterns, characters, or the like are printed in advance, these shapes are deformed. Further, also in the case where patterns, characters, or the like are to be printed later, it is difficult to print them on the surface on which projections and recesses are formed. Accordingly, the resin film is preferably a multilayer film including an adhesive layer composed of a hot-melt adhesive, and a film layer composed of an amorphous resin having a softening point higher than that of the hot-melt adhesive or a crystalline resin having a melting point higher than the softening point of the hot-melt adhesive.

In the case of determining the softening point of the hot-melt adhesive constituting the adhesive layer or the resin constituting the film layer, the softening point can be determined by the ring and ball method specified in JIS K6863: 1994 "TESTING METHODS FOR THE SOFTENING POINT OF HOT MELT ADHESIVES". Further, in the case of determining the melting point of the resin constituting the film layer, the melting point can be determined by the measurement method using a "heat flux DSC" specified in JIS K7121: 2012 "TESTING METHODS FOR TRANSITION TEMPERATURES OF PLASTICS".

In the case where the fiber sheet contains polyethylene terephthalate resin fibers or polyamide resin fibers, the hot-melt adhesive preferably contains a polyester polyurethane resin, in view of adhesiveness to the fiber sheet. When the resin film and the fiber sheet are brought into contact with each other for bonding, the number of contact points between them is advantageously larger, in order to exhibit a higher adhesion strength between the resin film and the fiber sheet. The same applies to the case of using materials other than hot-melt adhesives. In order to increase the contact points with the resin film, it is preferable that the fiber sheet be a woven fabric or a knitted fabric composed of a plurality of yarns, and the yarns be partially or fully bulky textured yarns.

As the bulky textured yarns, bulky yarns obtained by applying heat to twisted multi-filament yarns to have crimpability and thereafter untwisting the yarns, for example, can be employed. Such bulky textured yarns of this type are referred to also as, for example, woolly yarns and have a wool-like texture. The bulky yarns are supple and give good feeling to the foot, and therefore are suitable as yarns constituting the fiber sheet. The elastic yarns, the shrinkable yarns, or the like that are mono-filament yarns easily exhibit their properties. Therefore, for example, in the case of employing such mono-filament yarns as wefts, it is preferable that 5 or more and 95% or less be mono-filament yarns, and the remainder (95% to 5%) be bulky textured yarns, with respect to the total number of the wefts. The ratio of the bulky textured yarns to the total number of the wefts is more preferably 10% or more and 90% or less, further preferably 15% or more and 85% or less, particularly preferably 20% or more and 80% or less. In the aforementioned case, the ratio of the bulky textured yarns to the total number of the warps is preferably 50% or more, more preferably 60% or more.

In order to allow the upper material to exhibit suppleness, it is preferable that the resin film not excessively affect the elasticity of the fiber sheet. Specifically, in the case where the fiber sheet is a woven fabric of warps and wefts, the tensile stress (N) of the resin film is preferably smaller than the tensile stress (N) of the fiber sheet when it is pulled alone in the warp or weft direction at the same distance. In the case where the fiber sheet is a knitted fabric, the tensile stress (N) of the resin film is preferably smaller than the tensile stress (N) of the fiber sheet when it is pulled alone in the course or wale direction. The value of the tensile stress (N) of the resin film is preferably lower than the lowest value of the tensile stresses of the fiber sheet as determined in various directions. The tensile stress (N) of the resin film and the tensile stress of the fiber sheet can be determined by fabricating strip-shaped samples of them having the same width (for example, 10 mm) and subjecting the samples to a tensile test using a tensile tester. More specifically, the tensile stress of the resin film or the fiber sheet can be determined by determining the stress of each of the samples when the distance between chucks of the tensile tester is set to 25 mm, the sample is gripped by the chucks, and the sample is elongated by 5%. The tensile stress (N) of the resin film is preferably 75% or less, more preferably 50% or less, of the aforementioned lowest value.

The thickness of the resin film is generally 1 μm or more and 250 μm or less. The thickness is preferably 5 μm or more and 200 μm or less.

The shoe 1 of this embodiment is easily fabricated into a desired shape since the fiber sheet 2*a*' that exhibits heat shrinkability due to the shrinkable yarns as described above is used for forming the upper material 2. The shoe 1 of this embodiment can be fabricated, for example, by carrying out a molding step in which the upper material is placed on a shoe last and is deformed to conform to the shoe last. In a method for producing a shoe of this embodiment, the molding step is carried out using an upper material including a fiber sheet having heat shrinkability and therefore the upper material can be deformed to conform to the shoe last in the molding step by heating the upper material placed on the shoe last and thermally shrinking the fiber sheet. Accordingly, in the method for producing a shoe of this embodiment, the shape of the shoe last can be accurately reflected to the upper material. It is preferable to perform the molding step using a fiber sheet having different heat shrinkability in one direction from the heat shrinkability in the other direction orthogonal to the one direction as the aforementioned fiber sheet, and arranging the fiber sheet so that the heat shrinkability is higher in a direction orthogonal to the shoe center axis than in a direction along the shoe center axis, in that the shape of the shoe last can be reflected more accurately to the upper material.

According to such a method for producing a shoe, a shoe including an upper material that is partially or fully formed of a fiber sheet, wherein the fiber sheet has heat shrinkability and the heat shrinkability of the fiber sheet is higher in a direction orthogonal to the shoe center axis than in a direction along the shoe center axis can be obtained. Such a shoe is not only easily fabricated into a desired shape, but also allows the shape of the upper material to be easily finely adjusted, as needed, so as to fit to the foot of the user after the fabrication. That is, in the method for producing a shoe of this embodiment, after a shoe including an upper material that has a shape corresponding to one shoe last is fabricated, the shape of the upper material can be changed to a shape corresponding to another shoe last that has a different shape from the one shoe last, by abutting the other shoe last with the back surface side of the upper material, followed by heating. At this time, after the shoe having the upper material in a specific shape is fabricated using the one shoe last but before the shape of the upper material is changed to another shape using the other shoe last, the upper material may be stretched, for example, by accommodating another shoe last that is larger than the one shoe last in the shoe to apply a force to the upper material from the back surface side, as required. A specific description is given for this. For example, when ready-made shoes are purchased, there may be cases where the shoes are tight in the width direction of the feet if the shoes are selected to fit, to the feet lengths, and conversely, excess spaces are present in the toe portions if the shoes are selected to fit to the feet widths. However, the shoe of this embodiment can suppress the occurrence of such problems since the shape of the upper material can be adjusted. Further, for example, in shoelace shoes, fitting in the width direction of the feet can be adjusted also in conventional shoes by tightening or loosening the shoelaces, but in the case of the feet with high insteps, the tongues of the conventional shoes are largely exposed in, which may impair the appearance of the shoe in some cases. The shoe of this embodiment can also suppress the occurrence of such problems since the shape of the upper material can be adjusted. Further, even after the upper material is deformed, due to use by a user or the like, into a different shape from the shape immediately after the production as a new product, the shoe of this embodiment can allow the upper material to have a shape corresponding to a shoe last by abutting the shoe last with the upper material from the back surface side, followed by heating, so that the upper material can be restored to have a shape close to the state immediately after the production. Thus, the shoe of this embodiment has an advantage of easy repair.

Further, according to the method for producing a shoe of this embodiment, the fusible yarns can be thermally fused with other yarns in the molding step. According to the method for producing a shoe of this embodiment, a shoe, for example, in which the fiber sheet is a woven fabric or a knitted fabric composed of a plurality of yarns, and the yarns are partially or fully fusible yarns and are fused with one another by the fusible yarns can be obtained. That is, according to the method for producing a shoe of this embodiment, a shoe having excellent strength can be obtained. In that case, a shoe in which the shape is less likely to be deformed even when used in intense exercise can be obtained by fabricating an upper material in which the fiber sheet having yarns fused with one another is arranged in a portion covering one or more of the first metatarsophalangeal joint and the fifth metatarsophalangeal joint, as described above.

Thus, the shoe of this embodiment is not only excellent in comfort and has a shape that is less likely to be deformed, but also excellent in ease of production. The description of the above embodiment is merely an example, and the shoe according to the present invention and the manufacturing method thereof are not limited to the above embodiment at all. That is, various modifications can be made to the shoe according to the present invention without departing from the gist of the present invention.

REFERENCE SIGNS LIST

1: Shoe
2: Upper material
2*a*: Fiber sheet
3: Shoe sole member
CX: Shoe center axis

The invention claimed is:

1. A shoe, comprising:

an upper material that comprises a fiber sheet, wherein the fiber sheet exhibits both tensile characteristics (A) and (B) below at least in one direction:

(A) tensile characteristics such that an energy loss of a 10-mm-wide strip-shaped test piece made of the fiber sheet, when a load with a tensile energy of 50 mJ is applied to the test piece in the length direction and is then removed, is 40% or less; and (B) tensile strength such that a permanent strain of a 10-mm-wide strip-shaped test piece made of the fiber sheet, after a million times of deformation and restoration with an amount of strain determined by pulling the test piece in the length direction to a tensile energy of 50 mJ, is 10% or less; and wherein the fiber sheet is a woven fabric composed of a plurality of yarns or a knitted fabric composed of a plurality of yarns, the yarns of the woven fabric and the knitted fabric include partially or fully fused yarns that are fused with one another by fusible yarns, and the fiber sheet includes shrinkable yarns having a heat shrinkability and the upper material has a heat shrinkability higher in a direction orthogonal to a shoe center axis than in a direction along the shoe center axis.

2. The shoe according to claim 1, wherein the fiber sheet is arranged so that the upper material exhibits the tensile characteristics (A) and (B) in a direction within ±45° with respect to a direction orthogonal to the shoe center axis.

3. The shoe according to claim 1, wherein in the fiber sheet, the fusible yarns are arranged along a circumferential direction about the shoe center axis.

4. The shoe according to claim 1, wherein the upper material is formed of the fiber sheet in a portion that covers one or both of the first metatarsophalangeal joint and the fifth metatarsophalangeal joint, and the yarns are fused with one another in the portion.

5. The shoe according to claim 1, wherein the yarns of the woven fabric and the knitted fabric include partially or fully elastic yarns made of an elastomer.

6. The shoe according to claim 5, wherein the elastic yarns are mono-filament yarns.

7. The shoe according to claim 1, wherein the yarns of the woven fabric and the knitted fabric include partially or fully bulky textured yarns.

8. The shoe according to claim 1, wherein the upper material further comprises a resin film bonded to one side or both sides of the fiber sheet.

9. The shoe according to claim 1, wherein the fiber sheet further exhibits tensile characteristics (C) below in the direction in which the fiber sheet exhibits the tensile characteristics (A) and (B):

(C) an elongation such that a 10-mm-wide strip-shaped test piece made of the fiber sheet, when a tensile load of 10 kgf is applied to the test piece in the length direction, is 10% or more and 80% or less.

10. The shoe according to claim 1, wherein the fiber sheet comprises a shrinkable yarn, and ratios of the shrinkable yarn are different between one warp and another warp of the fiber sheet, or ratios of the shrinkable yarn are different between one weft and another weft of the fiber sheet.

11. The shoe according to claim 1, wherein the fusible yarns are composed of core-sheath fibers each having a core and a sheath, the core and the sheath are each composed of a polyester-based thermoplastic elastomer, and the polyester-based thermoplastic elastomer of the sheath has a lower melting point or glass transition temperature than the polyester-based thermoplastic elastomer of the core.

* * * * *